US006445348B1

(12) United States Patent
McCoy et al.

(10) Patent No.: US 6,445,348 B1
(45) **Date of Patent: *Sep. 3, 2002**

(54) DISPERSIVE SURFACE ANTENNA

(75) Inventors: Danny O. McCoy, Davie; Feng Niu, Weston, both of FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/579,604

(22) Filed: May 26, 2000

Related U.S. Application Data

(62) Division of application No. 09/323,644, filed on Jun. 1, 1999, now Pat. No. 6,160,515.

(51) Int. Cl.[7] ..... H01Q 1/24
(52) U.S. Cl. ..... 343/702; 343/830; 343/846
(58) Field of Search ..... 343/795, 702, 343/830, 846; H01Q 1/24, 1/36, 1/38

(56) References Cited

U.S. PATENT DOCUMENTS 4,980,694 A 12/1990 Hines ..... 343/702
5,410,749 A 4/1995 Siwiak et al. ..... 455/280
5,781,159 A * 7/1998 Desargant ..... 343/702
6,008,773 A 12/1999 Matsuoka et al. ..... 343/818
6,160,515 A * 12/2000 McCoy et al. ..... 343/702

* cited by examiner

*Primary Examiner*—Michael C. Wimer
(74) *Attorney, Agent, or Firm*—Barbara R. Doutre; Frank M. Scutch, III

(57) ABSTRACT

Dispersive surface antenna structures (300, 700) provide improved selectivity and increased control over bandwidth. Antenna structures (300, 700) include a wraparound piece of conductive material located perpendicular to a ground plane (304, 704). Ground posts (302, 702) extend up from the ground base (304) and capacitively couple to a front conductive surface (301, 701) of the antennas (300, 700). First and second conductive back surfaces (305, 306), (705, 706) are capacitively coupled across a gap (307, 707) along the back of the antennas (300, 700). The size, width, and location of the gap (307, 707) along with the ground posts (302, 702) provide increased control over antenna performance.

4 Claims, 7 Drawing Sheets

DISPERSIVE SURFACE ANTENNA

CROSS REFERENCE TO RELATED APPLICATIONS

This is a division of application Ser. No. 09/323,644, filed Jun. 1, 1999, and assigned to Motorola, Inc. now U.S. Pat. No. 6,160,515.

TECHNICAL FIELD

This invention relates in general to antennas and more specifically to dispersive surface antennas.

BACKGROUND

The current trend in the wireless communications industry is towards providing multiple services and worldwide coverage. Due to the co-existing multiple standards and the fact that different services are provided on different frequencies, there is an ever-growing need for multi-band operations and thus the need for multi-band antennas. The rapid development of various radio technologies has dramatically reduced radio volume and thickness. Furthermore, there are emerging technologies, such as time domain radios, which require extremely wide bandwidths, usually well over several hundred megahertz (MHz).

When a radio is operated in either dispatch mode (two-way radio) or phone mode (cellular phones, etc.), antenna efficiency is a major concern. High surface current density antennas, such as wire antennas, restrict currents to small areas. This creates larger near field power densities associated with higher absolute voltages and currents per unit area along the antenna. These types of antennas tend to be susceptible to near field coupling which can result in detuning and reduced far field radiation. Additional circuitry and battery power is often needed to compensate for these losses.

Two alternatives to the wire antenna are the patch antenna and the dispersive surface antenna. FIG. 1 is a front view of a prior art patch antenna structure 100. Antenna structure 100 consists of a radiating element 101 etched on one major surface 102 of a substrate 103. On an opposing substrate surface lies an etched ground plane (not shown). The antenna structure 100 includes an antenna feed 104 for feeding a radio frequency (RF) signal to and from the radiating element 101. Both the radiating element 101 and ground plane are typically made of a low loss conducting material such as copper. Substrate 103 may be made of various materials, such as printed circuit board materials. A disadvantage to the patch antenna is that high field concentrations exist between the radiating element 101 and ground plane. These regions absorb power, which ultimately gets converted to heat loss. Furthermore, most patch antennas have very narrow bandwidths, and those having wider bandwidths generally suffer from higher levels of loss and lower antenna radiation performance. While patch antennas can usually provide a good mechanical fit into most of today's communications devices, they are not, unfortunately, capable of meeting many of the required electrical standards.

FIG. 2 shows a prior art dispersive surface antenna structure 200. Antenna 200 includes a radiating element 201 etched onto one side of a substrate 202 which is located in a plane perpendicular to a ground surface 203, such as a radio case or equivalent. The mounting of antenna structure 200 is similar to that of a common monopole antenna. An RF feed 204 provides an input/output path for current. However, currently available dispersive surface antennas are still unable to provide the flexibility to control the frequency domain characteristics of the antenna.

Accordingly, there is a need for an improved dispersive surface antenna structure that overcomes the problems associated with currently available dispersive surface antennas. An antenna structure providing low surface current density features is highly desirable.

DETAILED DESCRIPTION OF THE PREFERRED EMBODIMENT

Figure 1:
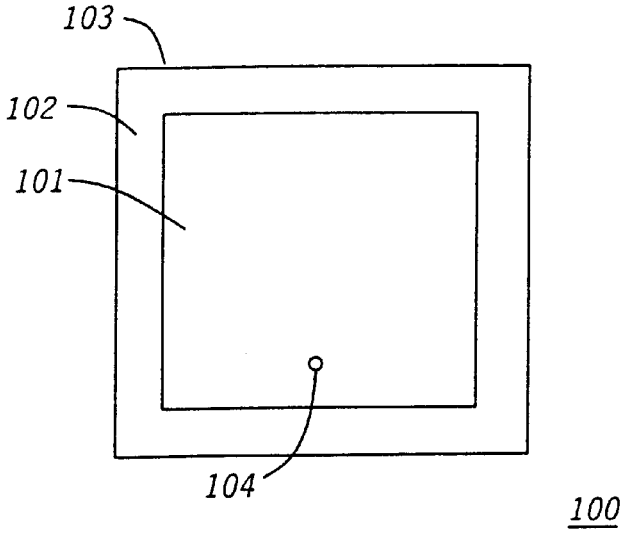
FIG. 1 (PRIOR ART)
FIG. 1 is a front view of a prior art patch antenna structure.
Figure 2:
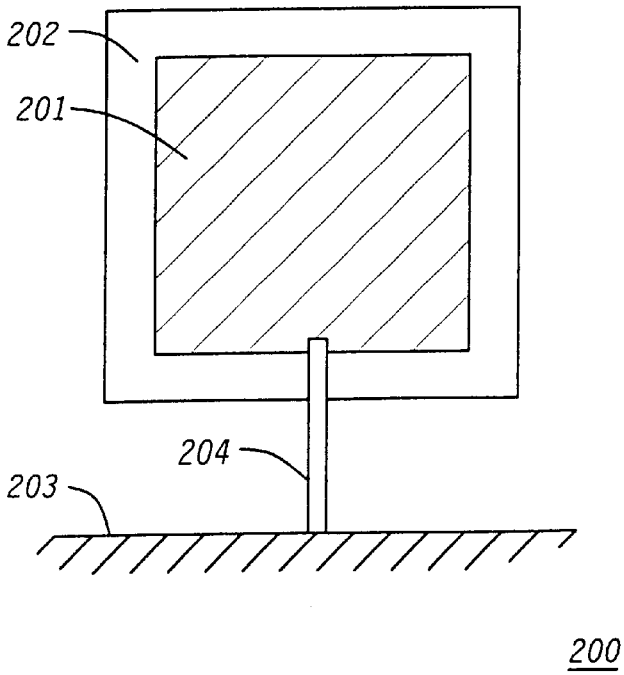
FIG. 2 (PRIOR ART)
FIG. 2 is a front view of a prior art dispersive surface antenna.
Figure 3:
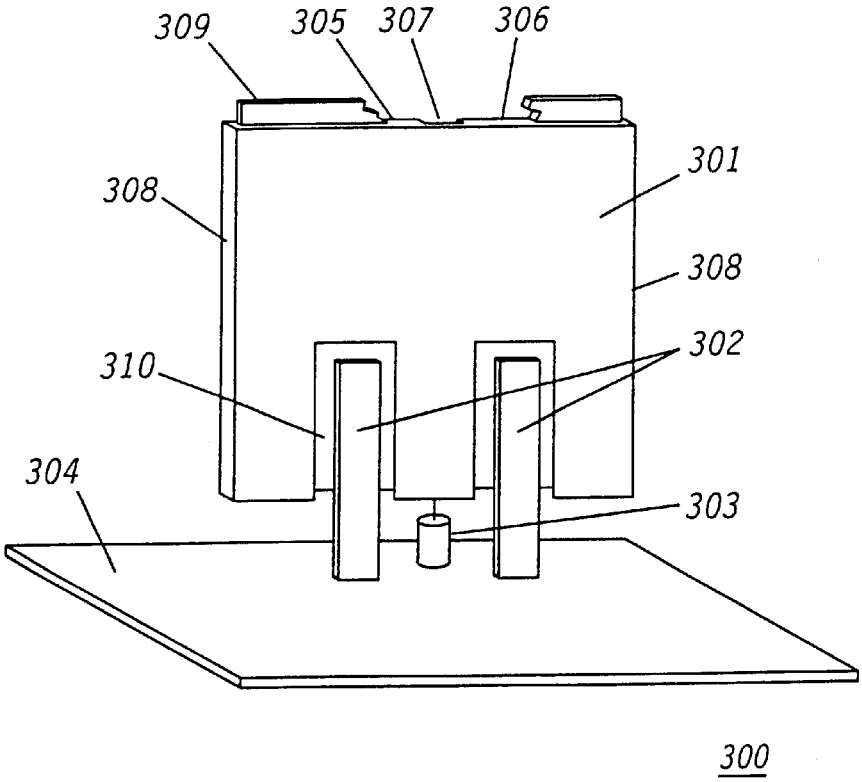
FIG. 3 is an isometric view of an antenna structure formed in accordance with a preferred embodiment of the invention.
Figure 4:
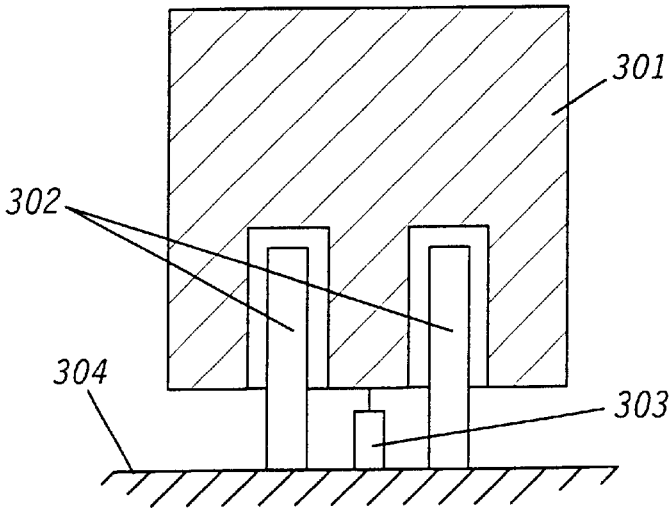
FIG. 4 is a front view of the antenna structure of FIG. 3 formed in accordance with the preferred embodiment of the invention.
Figure 5:
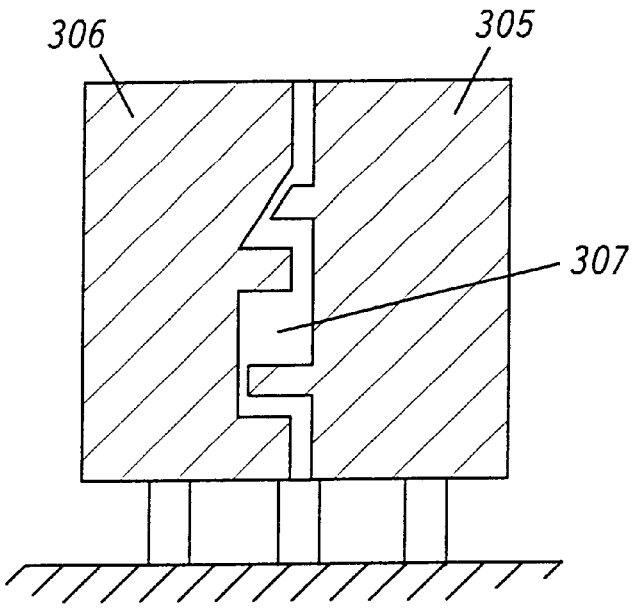
FIG. 5 is a back view of the antenna structure of FIG. 3 formed in accordance with the preferred embodiment of the invention.
Figure 6:
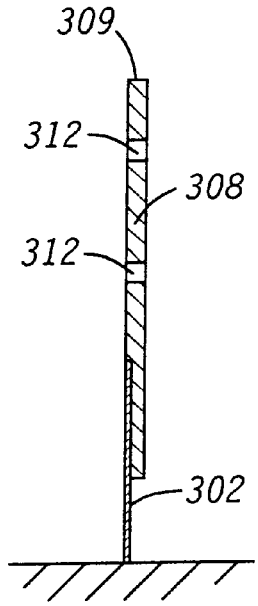
FIG. 6 is a cross-sectional side view of the antenna structure of FIG. 3 formed in accordance with the preferred embodiment of the invention.

Dispersive surface radiators typically measure near a quarter of free space wavelength along the direction parallel to current flow. These surface radiators work best when located away from grounds or other metallic objects located in parallel planes. In this respect, many dispersive surface antennas behave like quarter wavelength monopole antennas with omni-directional radiation in the plane perpendicular to the current flow direction. A radio case or other form of ground serves the purpose of forming the other half of the antenna system.

Referring now to FIGS. 3, 4, 5, and 6, there are shown isometric, front, back, and cross sectional side views respectively of an antenna 300 formed in accordance with a preferred embodiment of the invention. In accordance with the invention, antenna structure 300 includes a front conductive surface 301, conductive ground posts 302, RF feed 303, conductive ground base 304, and first and second conductive back surfaces 305, 306 having a gap 307 formed therebetween. The conductive surfaces 301, 305, 306 are preferably formed about a planar substrate 309. The substrate 309 and its conductive surfaces 301, 305, 306 are situated perpendicular to the ground base 304.

Front conductive surface 301 is preferably coupled to the first and second conductive back surfaces 305, 306 through vias 312 (shown in FIG. 6) located along side surfaces 308 of substrate 309. Alternatively, a single piece of molded metal can be formed about the substrate in a wrap-around style producing a solid conductive edge along sides 308.

In accordance with the invention, the ground posts 302 are coupled to the ground base 304 and are capacitively coupled to the conductive surfaces of the antenna structure. In accordance with a preferred embodiment of the invention, at least one slot 310 is formed within the front conductive surface 301 to accommodate at least one ground post 302. In accordance with the preferred embodiment of the invention, the ground posts 302 provide both electrical ground and structural support for the antenna structure 300. The grounding posts 302 can be stationary or adjustable. Adjustable ground posts vary the bandwidth of antenna structure 300 while variations in the gap size, width, and location alters the locations and widths of multiple bands. In accordance with the invention, the addition of capacitively coupled back surfaces 305, 306 and the addition of at least one ground post 302 provide a dispersive surface antenna with increased capabilities of multi-band control.

Figure 7:
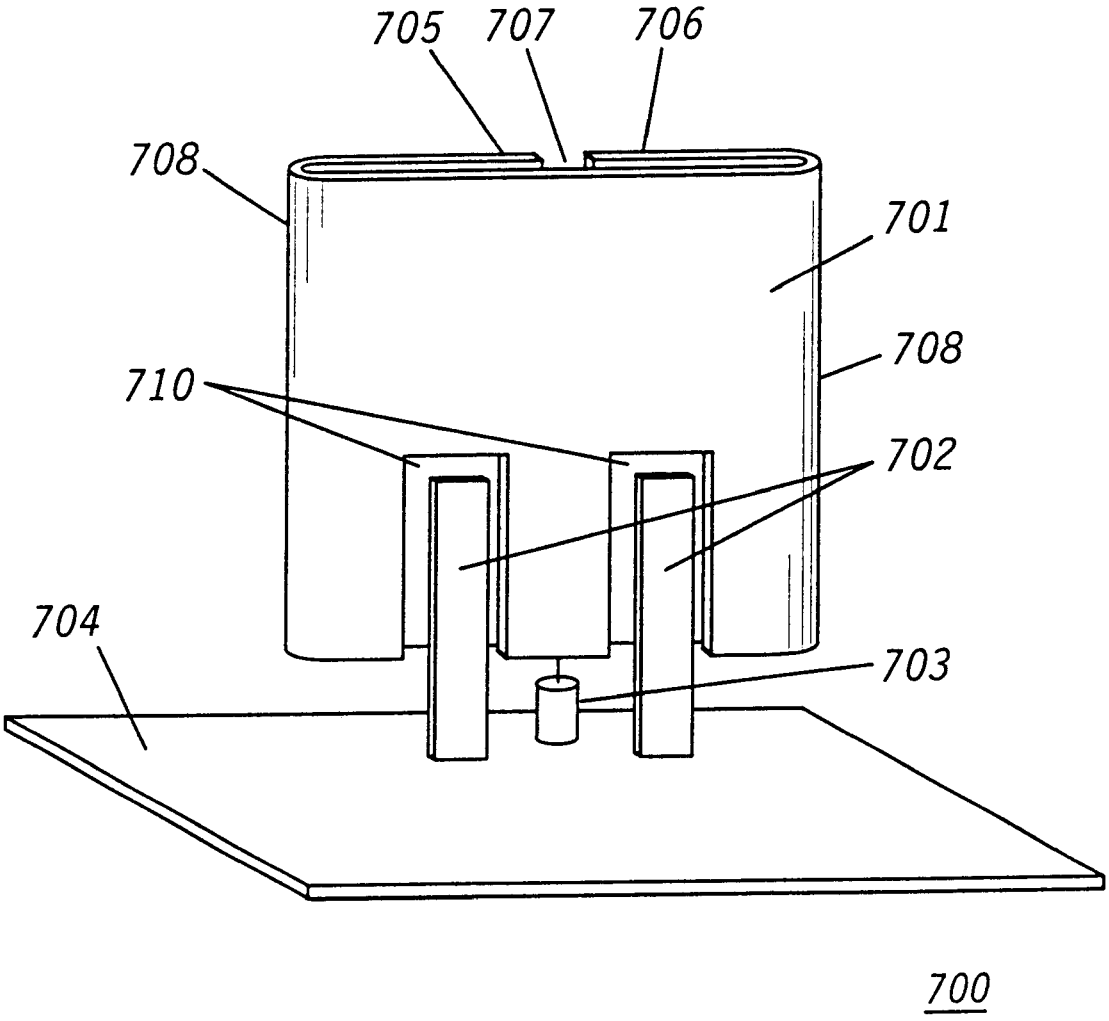
FIG. 7 is an antenna structure formed in accordance with an alternative embodiment of the invention.

FIG. 7 is a dispersive surface antenna 700 formed in accordance with an alternative embodiment of the invention. In accordance with the alternative embodiment, dispersive surface antenna 700 includes a unitarily molded piece of conductive material formed of front surface 701, side surfaces 708, and first and second back surfaces 705, 706 having a gap 707 formed therebetween. In accordance with the alternative embodiment, front surface 701 is physically supported by a source connection 703. Ground posts 702 extend substantially perpendicular from a ground plate 704. The grounding posts extend into the slots 710 so as to capacitively couple the grounding posts to the front conductive surface 701.

The use of ground posts 302, 702 shown and described in both embodiments provides many benefits. The ground posts 302, 702 provide control of the current flow so as to change the antenna frequency spectra. The ground posts may be implemented as stationary posts or made adjustable by using self-supporting cylindrical sliding rods.

Figure 8:
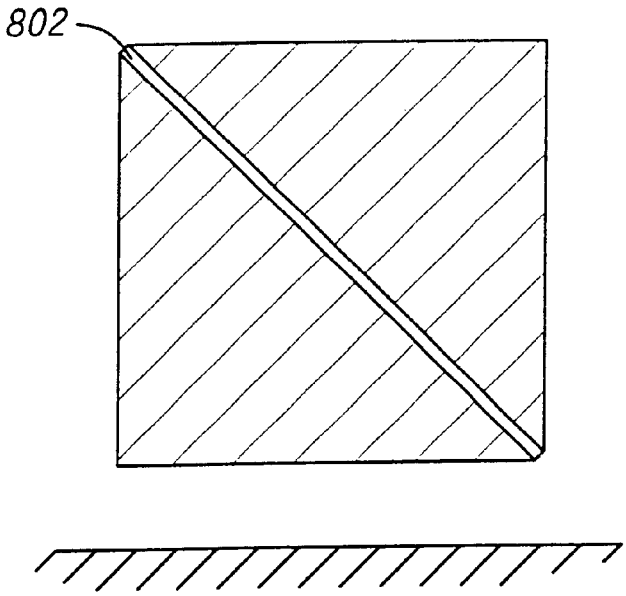
FIGS. 8–9 are examples of alternative back views for the antenna structures of FIGS. 3 and 7.
Figure 9:
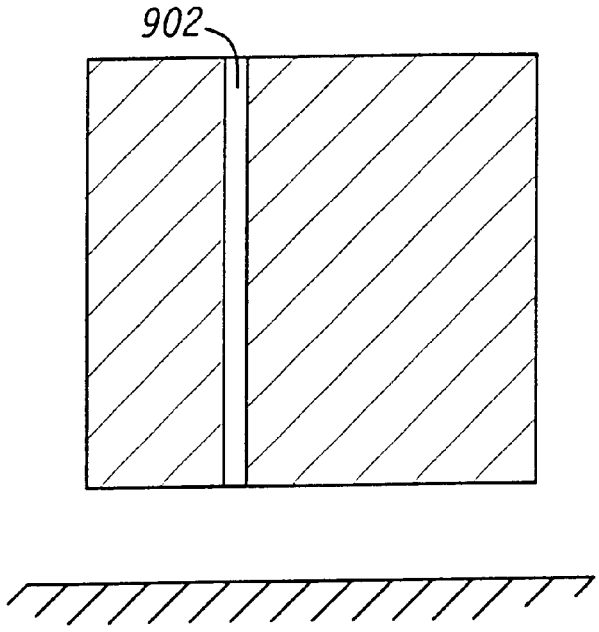

The gaps 307, 707 separating the two back surfaces of the antenna structures 300, 700 can vary in shape, size, and location. By shifting the gap to the side 308, 708, two parallel conductive surfaces become capacitively coupled across the gap, with at least one ground post capacitively coupled to one of the at least two parallel conductive surfaces. The location and shape of the gap can be varied to adjust the antenna frequency spectrum over which the antenna operates. Widening the width of an off-center gap between first and second back surfaces alters the antenna frequency characteristics from multiple bands towards a single, wideband. Widening the width of a centered gap between back surfaces broadens the antenna frequency bandwidth. FIG. 8 shows an example of a slanted gap 802 that has the effect of modifying the multiband characteristics as well as additional flexibility of control. Moving the gap off center tends to split the single bandwidth performance into multiple bands. FIG. 9 shows an example of a straight edge gap 902 being moved off center to vary the frequency response.

Antenna structures 300, 700 have frequency response characteristics adjustable between multiple bands and ultra-wide bands. The antennas 300, 700 of the present invention are self-supporting and can be readily incorporated into many of today's communications products. The capacitive coupling used in both embodiments varies with frequency and thus provides additional freedom to adjust antenna bandwidth and improve return loss.

The antenna structures 300, 700 of the present invention function similarly to quarter wavelength monopole antennas. The addition of the back conductive surfaces 305, 306 and 705, 706 essentially creates a single large wrap-around surface, which effectively spreads out the current flow. Unlike conventional wire antennas (monopoles, dipoles, helices, or loops), the dispersive surface antenna structures 300, 700 of the present invention do not restrict the current flow on the antenna to follow a specific path. As a result, increased bandwidth is obtained by adjusting the ground posts. Furthermore, for any given frequency, the current density on the antenna structures 300, 700 are much lower than typical wire antennas under the same operating conditions, and thus near field losses are minimized, with resulting desired improvements in far field radiation. The dispersive surface antennas 300, 700 have gain characteristics that compare favorably to a monopole wire antenna gain.

Figure 10:
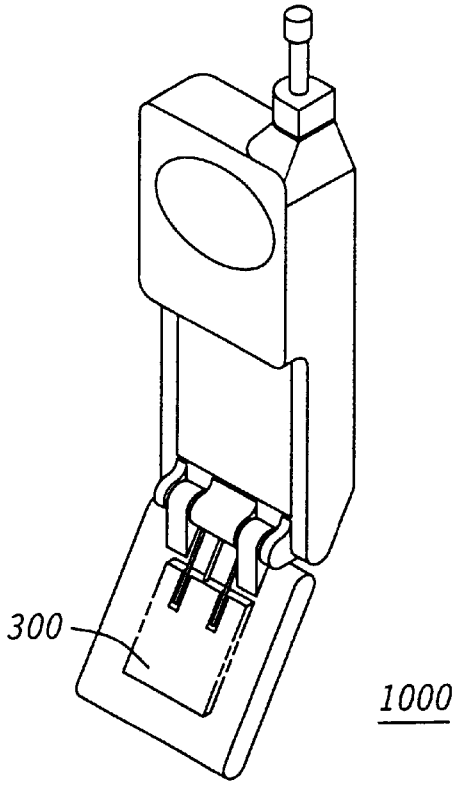
FIG. 10 is a communication device employing an antenna structure formed in accordance with the preferred embodiment of the invention.
Figure 11:
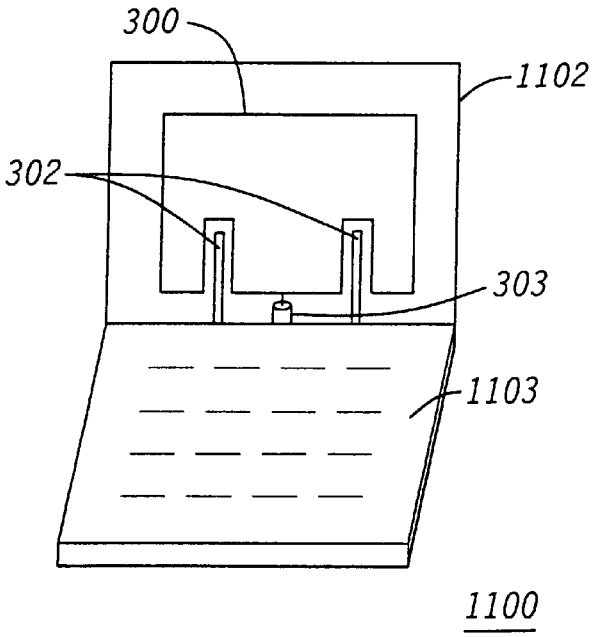
FIG. 11 is another communication device employing an antenna structure formed in accordance with the preferred embodiment of the invention.

The dispersive surface antennas 300, 400 of the present invention are an attractive solution to many of today's communication applications. Two potential applications are shown in FIGS. 10 and 11. FIG. 10 is a communication device 1000, such as a cellular phone, utilizing the antenna structure 300 formed in accordance with the preferred embodiment invention. FIG. 11 shows the antenna structure 300 incorporated into a laptop communicator 1100. The ground posts 302 are shown coupled to the edge of device's ground, such as to the keyboard 1103. The conductive surfaces sit substantially perpendicular to the ground.

Figure 12:
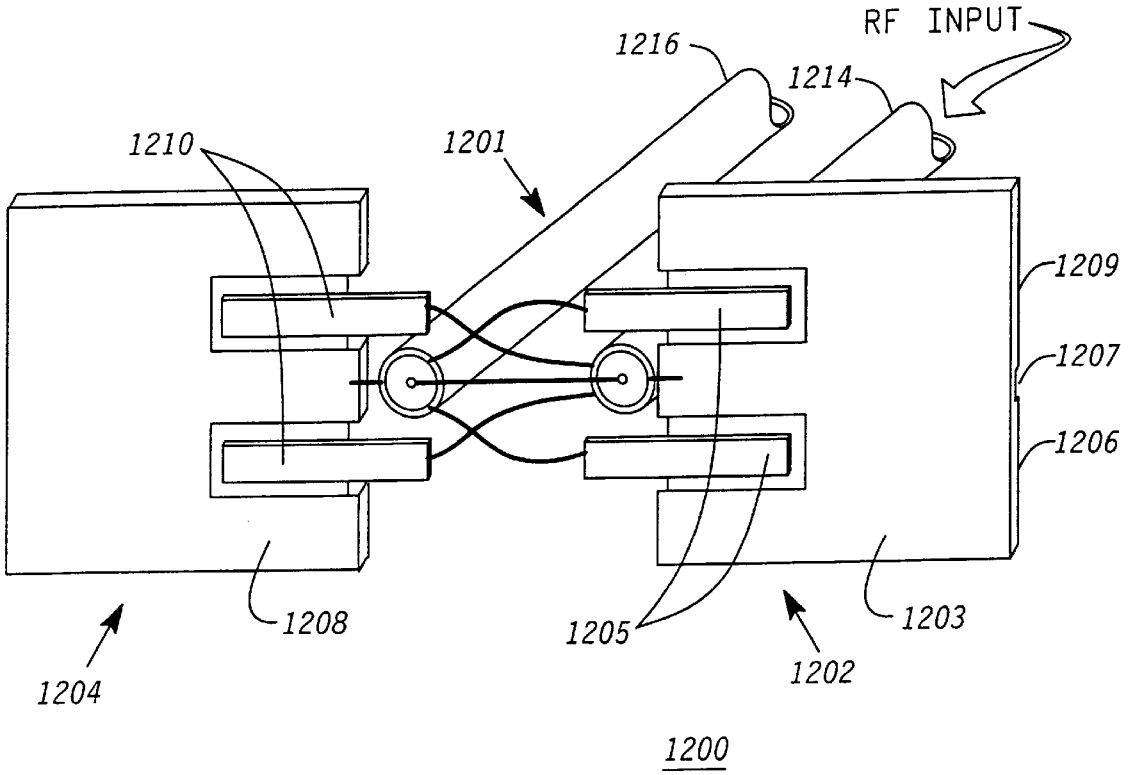
FIG. 12 is an isometric view of an antenna structure formed in accordance with another alternative embodiment of the invention.

FIG. 12 is an isometric view of a dipole antenna structure 1200 formed by the combination of two antenna structures formed in accordance with the preferred embodiment. Here, a dual-coaxial balun 1201 is used to feed two antenna structures 1202, 1204. The first dispersive surface antenna 1202, includes a front conductive surface 1203, at least one grounding post 1205 capacitively coupled to the front conductive surface, and first and second conductive back surfaces 1206, 1209 separated by a gap 1207.

The second dispersive surface antenna 1204 includes a second front conductive surface 1208, a conductive post 1210 capacitively coupled to the second front conductive surface 1208, and third and fourth conductive back surfaces separated by a gap (not shown). The balun 1201 includes first and second shielded portions 1214, 1216, the first shielded portion 1214 carries a radio frequency (RF) signal to the front conducting surface of the first antenna 1202. The first shielded portion 1214 is also coupled to the conductive post 1210 of the second dispersive surface antenna 1204. The second shielded portion 1216 is coupled to the second front conductive surface 1208 of the second dispersive antenna 1204. Ground posts 1205 connect to the second shielded portion 1216 of a balun 1201, such as a Roberts balun known in the art. The antenna assembly 1200 provides a 180-degree phase shift between the first and second dispersive surface antennas 1202, 1204. This antenna structure provides the advantages of broadband or multiband performance along with low surface current densities.

The dispersive antenna structures of the present invention provide low surface current density performance. This type of performance provides the benefits of improved antenna efficiency and reduced battery power consumption. The benefits of wider bandwidth, improved return loss and gain, improved selectivity, and multiband capability, that are generally heavily compromised in prior art antennas, are all advantages achieved with the dispersive surface antenna(s) of the present invention. The use of grounding posts, conductive surface areas, gaps, and symmetrical/asymmetrical alterations make the antenna structure of the present invention quite versatile. Numerous modifications, changes, variations, substitutions and equivalents will occur to those skilled in the art without departing from the spirit and scope of the present invention as defined by the appended claims.

What is claimed is:

1. A dispersive surface antenna, comprising:

at least two parallel conductive planar surfaces capacitively coupled across an air gap;

a radio frequency (RF) feed coupled to one of the at least two parallel conductive planar surfaces;

a conductive ground plane located perpendicular to the conductive surfaces; and a plurality of planar ground posts coupled to the conductive ground plane and where the plurality of ground posts extend substantially perpendicular from the conductive ground plane and are capacitively coupled to one of the at least two parallel conductive surfaces.

2. A dispersive surface antenna, comprising:

a unitarily molded piece of conductive metal forming a front surface, first and second side surfaces, and first and second back surfaces separated by a gap;

a radio frequency (RF) feed coupled to the front conductive surface;

a conductive ground base located perpendicular to the unitarily molded piece of conductive metal; and at least one ground post coupled between the conductive ground base, the at least one ground post capacitively coupled to the front conductive surface.

3. The antenna of claim 2, wherein the at least one ground post is adjustable for altering frequency selectivity of the antenna.

4. The antenna of claim 2, wherein the antenna is used in a radio.

* * * * *

UNITED STATES PATENT AND TRADEMARK OFFICE

CERTIFICATE OF CORRECTION

PATENT NO. : 6,445,348 B1
DATED : September 3, 2002
INVENTOR(S) : Danny O. McCoy et al.

It is certified that error appears in the above-identified patent and that said Letters Patent is hereby corrected as shown below:

Column 6,
Line 5, after "front" and before "surface" insert -- planar --;
after "side" and before "surfaces," insert -- planar --;

Line 6, after "back" and before "surfaces" insert -- planar --;
after "by" delete "a" and insert therefor -- an --;
after newly-inserted "an" and before "gap" insert -- air --;

Lines 7 and 8, delete "conductive" and insert therefor -- planar --.

Signed and Sealed this

Twentieth Day of May, 2003

JAMES E. ROGAN
*Director of the United States Patent and Trademark Office*